US006974395B1

(12) United States Patent
Rioux et al.

(10) Patent No.: US 6,974,395 B1
(45) Date of Patent: Dec. 13, 2005

(54) GOLF CLUB AND BALL MARKING AND ALIGNMENT DEVICE

(75) Inventors: Roger Rioux, Fort Lee, NJ (US); Jeannmarie Rioux, Elmwood Park, NJ (US); Martin Wendelken, Jr., Elmwood Park, NJ (US)

(73) Assignees: Roger H. Rioux, Fort Lee, NJ (US); Jeanne-Marie Rioux; Martin Wendelkin

( * ) Notice: Subject to any disclaimer, the term of this patent is extended or adjusted under 35 U.S.C. 154(b) by 0 days.

(21) Appl. No.: 10/621,307

(22) Filed: Jul. 18, 2003

(51) Int. Cl.[7] ..... A63B 69/36
(52) U.S. Cl. ..... 473/409; 473/219
(58) Field of Search ..... 473/219, 409, 473/226, 231

(56) References Cited

U.S. PATENT DOCUMENTS

| | | | | |
|---|---|---|---|---|
| 4,209,172 | A * | 6/1980 | Yamamoto | 473/200 |
| 5,878,659 | A | 3/1999 | Hatter | |
| 5,925,186 | A | 7/1999 | Klimek | |
| 6,062,986 | A | 5/2000 | Kaise | |
| 6,209,452 | B1 | 4/2001 | Klimek | |
| 6,422,949 | B1 * | 7/2002 | Byrne et al. | 473/200 |
| 6,453,807 | B1 | 9/2002 | Ramey | |
| 6,471,599 | B2 | 10/2002 | Ford | |
| 6,739,980 | B2 * | 5/2004 | Scott et al. | 473/200 |
| 2003/0013538 | A1 * | 1/2003 | Daniels | 473/248 |
| 2003/0013539 | A1 | 1/2003 | Scott | |

* cited by examiner

*Primary Examiner*—Raleigh W. Chiu

(57) ABSTRACT

A golf club and golf ball marking and alignment device 10 which provides a method to place identification and or other indicia on the surface of a golf club head 34 and golf ball 38. The marking and alignment device 10 contains a well 14 that contains a arc for a golf club head 34 and a golf club head centering band 22 that provide a central window to mark the central dorsal surface of a golf club head 34. Marking and alignment device 10 also has a second well to accommodate a golf ball 38 and a golf ball cover 12 which has an opening 30 to allow for marking a golf ball with a variety of markings or symbols. Once a golf club head 34 and golf ball 38 are marked, the marking provide both identification and properties for users of the golf equipment.

1 Claim, 8 Drawing Sheets

GOLF CLUB AND BALL MARKING AND ALIGNMENT DEVICE

FIELD OF THE INVENTION

The field of the invention relates to a golf club and ball alignment system and, more particular, to a mechanical, self centering alignment system that marks golf clubs and golf balls including the use of personalized logos or other such marks.

BRIEF DESCRIPTION OF PRIOR ART AND BACKGROUND OF THE INVENTION

The rules of golf state that a player is responsible for marking his ball. The disclosed novel system that embraces this rule and uses it for equipment identification while additionally helping a golfer align oneself during play. In golf, the key to a consistent ball flight path is to insure the club face is square to the target. To aid a golfer in squaring the clubface to the target, this novel marking device allows the player to put matching marks on both the ball and club head. After a person mark their equipment, a player then simply aligns the marks on the ball with the marks on the club insuring that the clubface is square to the ball and to the target. These matching marks on the club and ball now simplify the alignment process by visually changing the alignment points. Instead of trying to line up a round ball with an oval, round, or flat club face, any variety of indicia or markings may be placed on a ball and club head provide true alignment. A player may mark his ball and clubs with letters, symbols, pictures, or lines by using this alignment device. This novel system provides a rectangular surface with unlimited marking capabilities that brings together and squares a golf ball and golf club face. A person when playing golf in the address position, normally sees and tries to hit a round ball with a club face that is round, oval, or flat. Using this system of marking a golf ball and golf club head, a player in the address position initially visualizes one long continuous rectangle that is formed by the marks when the ball and club head are together. In addition, when a player is going to strike a marked golf ball with a marked club head, a flat end of the rectangle on the club head is now used to strike a flat end of the rectangle on the ball squaring and aligning the entire process. Further, when a player addresses the marked golf ball and golf club, this aligning process automatically changes the player's body position and aligns the body toward the target. This body alignment occurs because the club shaft must be positioned correctly thus forcing the hands of the player to be slightly in front of the marked golf ball.

Golf, besides being a sport, is a hobby enjoyed by millions of people. Many people invest great sums of money in golf related equipment and peripherals including expensive clubs, balls, bags, gloves, and alike. When two players sport similar or exactly the same equipment, it is an advantage to having some kind of marking on such equipment to allow it to be identified and distinguish it from each other. In addition, such marking can give owners security in that their equipment can be easily identified and discourages theft.

There are a number of patents used to mark a golf ball such as U.S. Pat. No. 5,878,659 (1999) Hatter; where a flexible template with alpha-numeric openings is described. Hatter, illustrates a method of marking a ball by wrapping the template around a ball, and then uses a pen to trace the template to place a number or letters on golf balls. Klimek, in U.S. Pat. No. 6,209,452 (2001) also describes a golf ball marking template that contains a number of embodiments that contain templates or shapes which wrap around a golf ball and then use a pen to mark a ball by tracing a shape. Still another golf ball marking template is described by Klimek in U.S. Pat. No. 5,925,186 (1999) which involves a tray containing a number templates in order to make a shape on the surface of a golf ball. In U.S. Pat. No. 6,453,807 (2002) Ramey; describes a golf ball marker that provides for a single line drawn on the surface of a ball for alignment. Although the above ball markers are novel for their intended purpose, they fail to provide a method to customize the golf balls in that the users must rely on the given templates provided.

Golf ball and golf club alignment combinations have been described in a number of patents where marks on a golf ball tend to align with marks on a golf club. In U.S. Pat. No. 6,422,949 (2002) Byrne, et al. describes a golf ball and putter having lines on each that match with the intent to provide alignment. Other patents like U.S. Pat. No. 6,062,986 (2000) Kalse; and U.S. Pat. No. 6,471,599 (2002) Ford; describe golf putters and irons (respectively) that contain marking on various areas of the club surface to help provide alignment but nether include lines on the golf ball. In U.S. Patent Application Publication No. 2003/0013539 (2003) Scott et al., teaches about alignment lines on a golf club and golf ball that match in shape to provide alignment. Scott et al., further talks about the blending of colors with golf ball rotation to identify to the golfer that a ball is rolling in the proper direction. While these patents provide methods of alignment of the golf ball and club, the users of these systems must purchase the specialized clubs and balls that contain the marking to benefit from their intended use. None of these alignment methods provide for marking previously owned golf clubs and balls. In U.S. Patent Application Publication No. 2009/0013538 (2003) Daniels; teaches a method of golf club alignment using a device to find the center of a golf club. While this method provides for marking the center of a club with a marker, it is rather complex in that it involves the use of angles, rulers, and protractors to achieve this measure.

While all the above methods of ball markers, pre-marked golf balls and clubs, suggested alignment systems, and a club centering device are fine for there intended purposes, none of the patents teach about markings for security and equipment identification.

The present invention provides a method of marking golf balls and clubs for the purpose of personalizing their golf equipment, while providing alignment of the golf ball and club during play. The novel device employs a method to center the face of a golf club which is essentially self-centering. The herein described alignment system can be used on all clubs and golf balls so that the owner does not have to purchase new equipment. It is the intention of the described device not to be limited to specific lines or indicia, rather it provides alignment and identification areas to be filled with any type of marks. Some examples include company symbols or trademarks, personal signatures or initials, names, street address, or pictures. The described personalizing golf ball and club alignment system provides its users with many benefits that previous methods fail to include.

OBJECTIVES AND ADVANTAGES

It appears that this novel disclosed golf ball and club marking and alignment device has the ability to fulfill the needs of golfers by providing a method to identify their equipment and provide an alignment tool during play.

A principal objective of this marking and alignment system is to provide a method to find the center of the face of a golf club.

Another objective of this marking and alignment system is to have a device that is easy to use.

A further objective of this marking and alignment method is to eliminate complex methods of obtaining measurements that involve the use of external devices such as protractors and angle measuring tools.

Still another objective of this marking and alignment method is to provide a golfer with the ability to mark the center of the club face with a variety of markings including symbols, letters, numbers, lines, shapes, pictures, and trademarks for esthetic decorative proposes.

Another objective of this marking and alignment system is allow a golfer to mark golf balls with a variety of markings including symbols, letters, numbers, lines, shapes, pictures, and trademarks for alignment purposes.

Still another objective of this golf ball and club marking and alignment system is to provide personal identification markings for security reasons.

Yet another objective of this marking and alignment system is to provide a means to mark all type of golf clubs and balls that are newly purchased or are old and already owned by a golfer.

BRIEF DESCRIPTION OF DRAWINGS

These objectives along with a method of marking and aligning golf balls and clubs will become apparent with the following description and clarified with referral to drawings provided.

REFERENCE NUMERALS IN DRAWINGS

Figure 1:
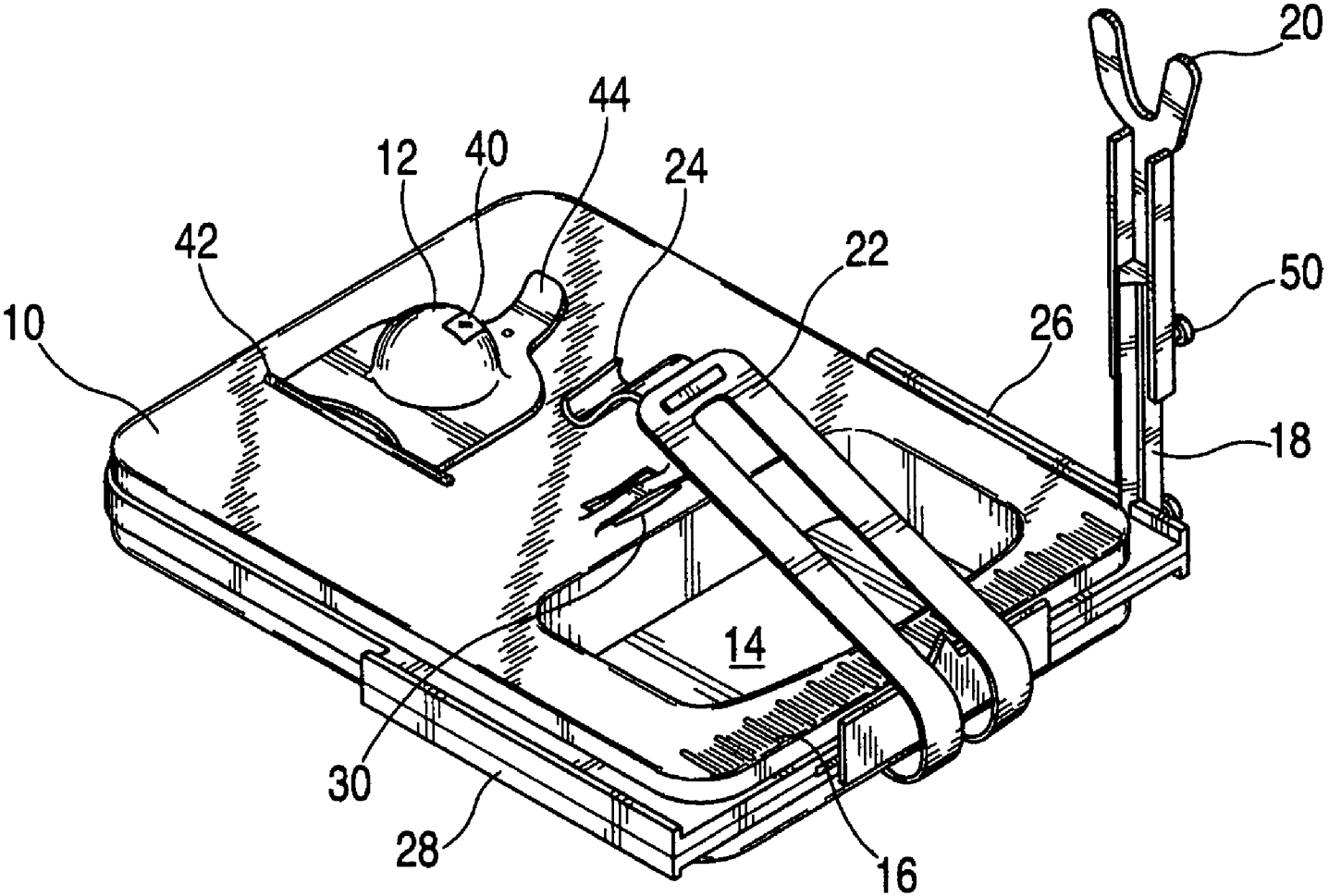
FIG. 1 is a perspective view of the golf club and ball marking/alignment device.

10 Golf club and ball marking/alignment Body
12 golf ball cover
14 Golf club head well
16 golf club face centering marks
18 golf club shaft support arm
20 golf club shaft centering guide
22 golf club head centering band
24 centering band securing strap
26 golf club support guide right
28 golf club support guide left
30 opening in body
32 golf ball well
34 golf club head
36 golf club shaft
38 golf ball
40 golf ball cover marking window
42 golf ball cover hinge
44 golf ball cover handle
46 golf ball marking/alignment area
48 golf club marking/alignment area

OVERALL DESCRIPTION OF EMBODIMENT—FIGS. 1 to 12

Referring to FIG. 1, a perspective overall view of the golf club and ball marking/alignment device body 10 which is preferably made of durable plastic or other moldable substance such as aluminum. Body 10 contains a well 14 that is shaped to accept and can accommodate the various sizes and shapes of golf club heads including drivers, irons, and putters. Golf ball cover 12 is attached to body 10 by using hinge 42 which allows golf ball cover 12 to be opened or closed using golf ball cover handle 44. Also in FIG. 1 is a view of the relationship of club head centering band 22 which is centered over golf club head well 14. On the distal end of golf club head centering band 22, a securing strap 24 is fed through openings 30 in body 10 to temporally affix the distal end of centering band 22 to body 10. Golf club shaft support arm 18 in FIG. 1 is attached to body 10 and slides along golf club support guide right 26 for right handed golf clubs while golf club support guide 28 is used for left handed golf clubs. Golf club support arm 18 has an adjustment screw 50 which allows golf club shaft centering guide 20 to be raised or lowered to accommodate different size golf clubs. The top front edge of body 10 has alignment markings 16 that are used to center the face of a golf club.

Figure 2:
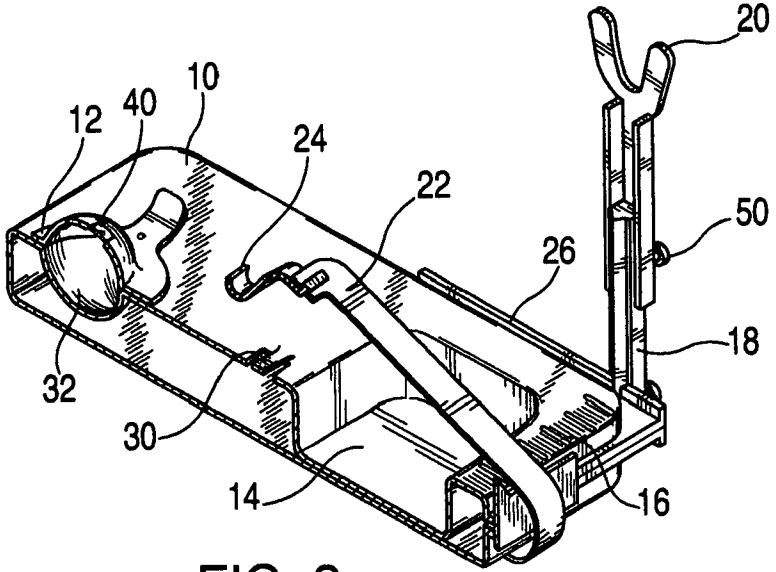
FIG. 2 is a drawing of the golf club and ball marking/alignment device as taken in the direction of arrows 2—2 seen in FIG. 1

FIG. 2 is a drawing of golf club and ball marking/alignment device having been divided along lines 2—2 in FIG. 1. Note body 10 has golf club well 14, golf ball well 32, and openings 30 within. Golf ball well 32 has golf ball cover 12 in closed position, golf club head centering band 22 with centering band securing strap 24 is over golf club well 14. Front end of body 10 has golf club face centering marks 16 on top surface. Golf club support arm 18 is mounted on golf club support guide right 26 for right handed golf clubs.

Figure 3:
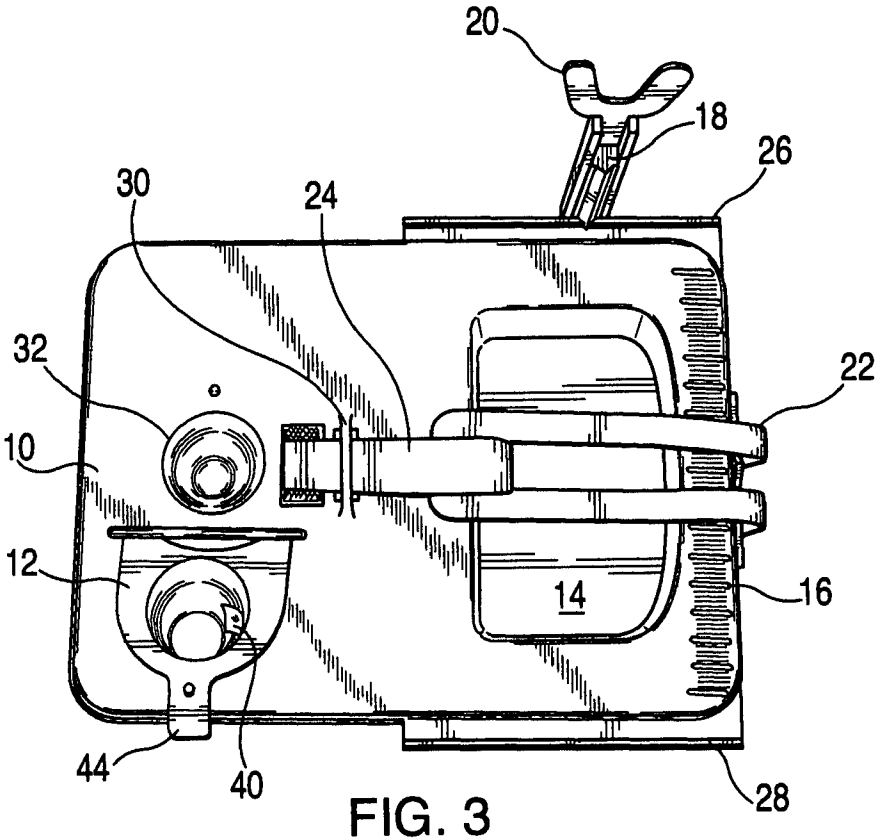
FIG. 3 is a top overall view of the golf club and ball marking/alignment device.

FIG. 3, is a top overall view of golf club and ball marking/alignment body 10 again illustrating the relationship of its main components. Note that golf ball cover 12 in the open position exposing golf ball well 32. Golf ball cover 12 has a golf ball marking window 40 that can be seen here in FIG. 3. Directing attention to golf club head well 14, in this view note that the front wall of golf club head well 14 is shaped to form an arc. Also note that golf club head centering band 22 traverses the center of golf club well 14 which terminates and attaches to body 10 using securing band 24. Golf club shaft support arm 18 with golf club shaft support 20 is presently affixed to right golf club support guide 26 and is in position to support a right handed golf club. Golf club shaft support arm 18 along with golf club shaft support 20 can be move and affixed to left golf club support guide 28 when it is necessary to support a left handed golf club. Golf club face centering marks 16 on body 10 are visualized and span the entire width of the front end of golf club well 14.

Figure 4:
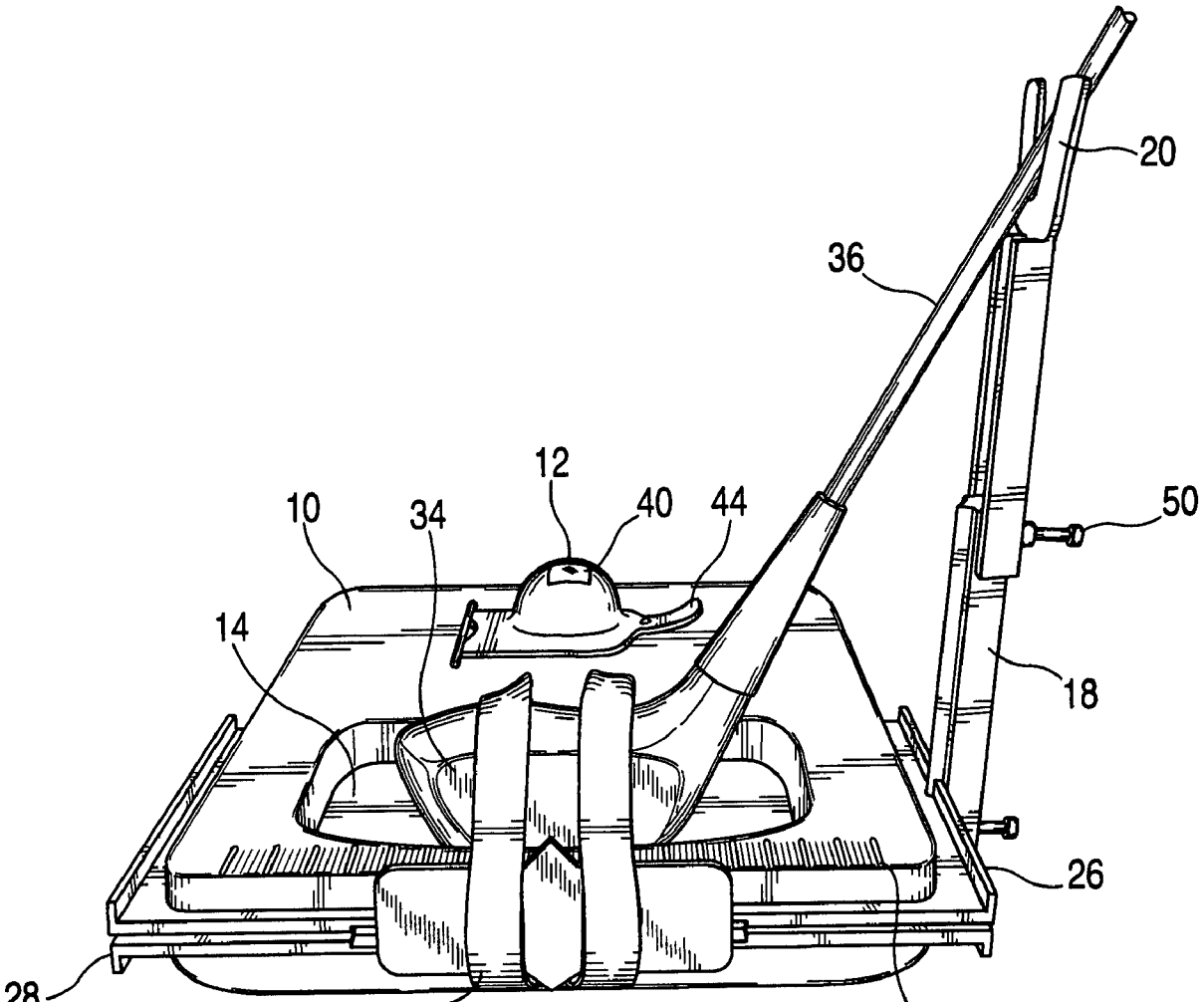
FIG. 4 is an overall view of the golf club and ball marking/alignment device with a club in the alignment position.

Directing ones attention to FIG. 4, observe that golf club and ball marking/alignment device body 10 now has a golf club head 34 placed within golf club head well 14. FIG. 4 illustrates the linear alignment relationship between the center of golf club well 14, the center of the golf club face centering marks 16, golf club head centering strap 22, and golf ball cover 12 in closed position. Note that golf club shaft support arm 18 and golf club shaft centering guide 20 holds golf club shaft 36 at a level which allows the bottom surface of golf club head 34 to be centered and level within golf club head well 14. The proper height of golf club shaft support arm 18 is achieved using golf club support arm adjustment screw 50 while alignment is found by sliding golf club shaft support arm 18 forward and backward on golf club support guide right 26.

Figure 5:
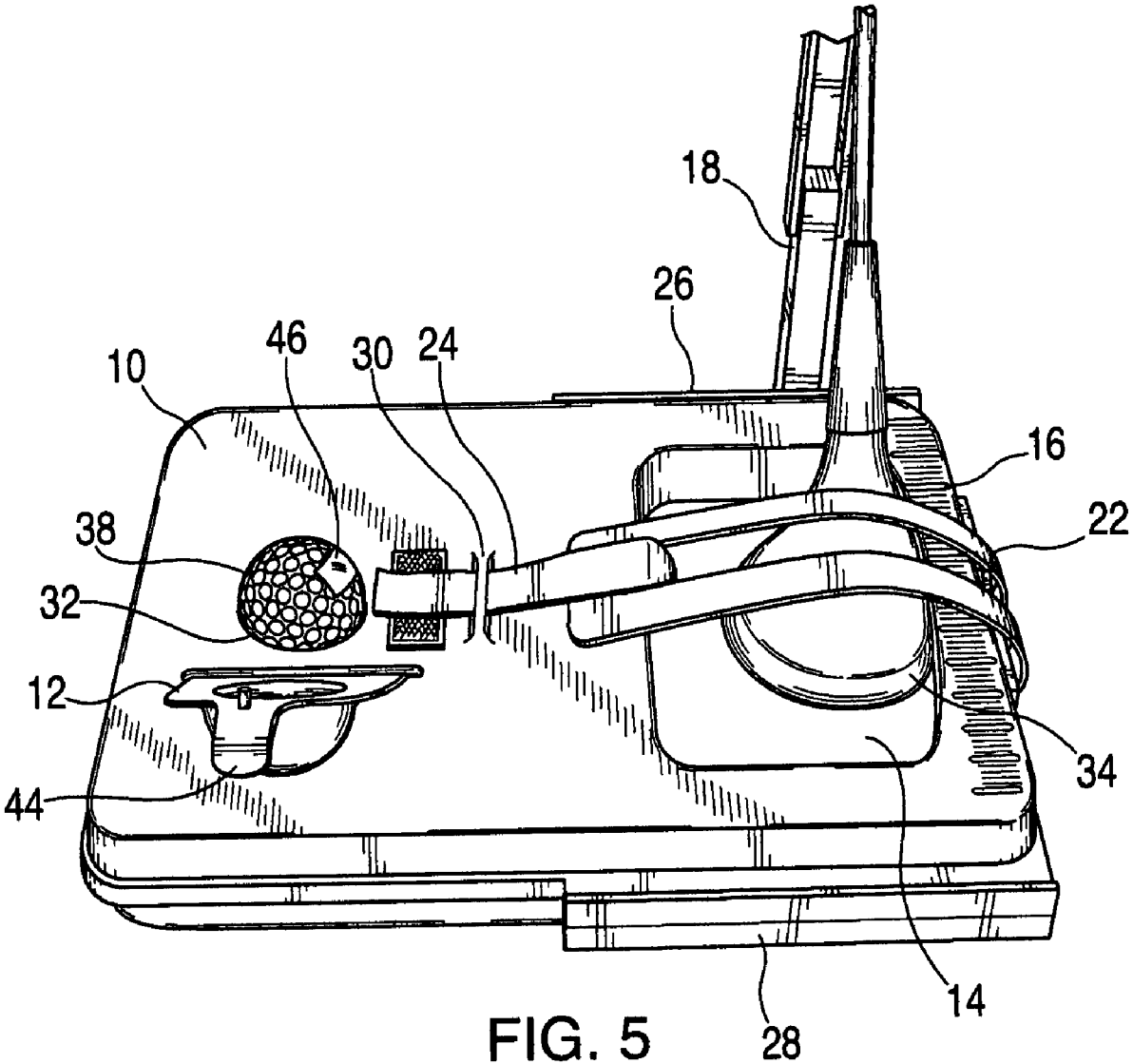
FIG. 5 is a topside view of the golf club and ball marking/alignment device with a club and ball in their alignment positions.

FIG. 5 illustrates an overall side view of golf club and ball marking/alignment device body 10 and the relationship of a golf club head 34 placed within golf club head well 14. Golf club head centering band 22 is placed over golf club head 34 and securing band 24 is attached to body 10. FIG. 5 demonstrates golf ball cover 12 open exposing a golf ball 38 placed with golf ball well 32.

Figure 6:
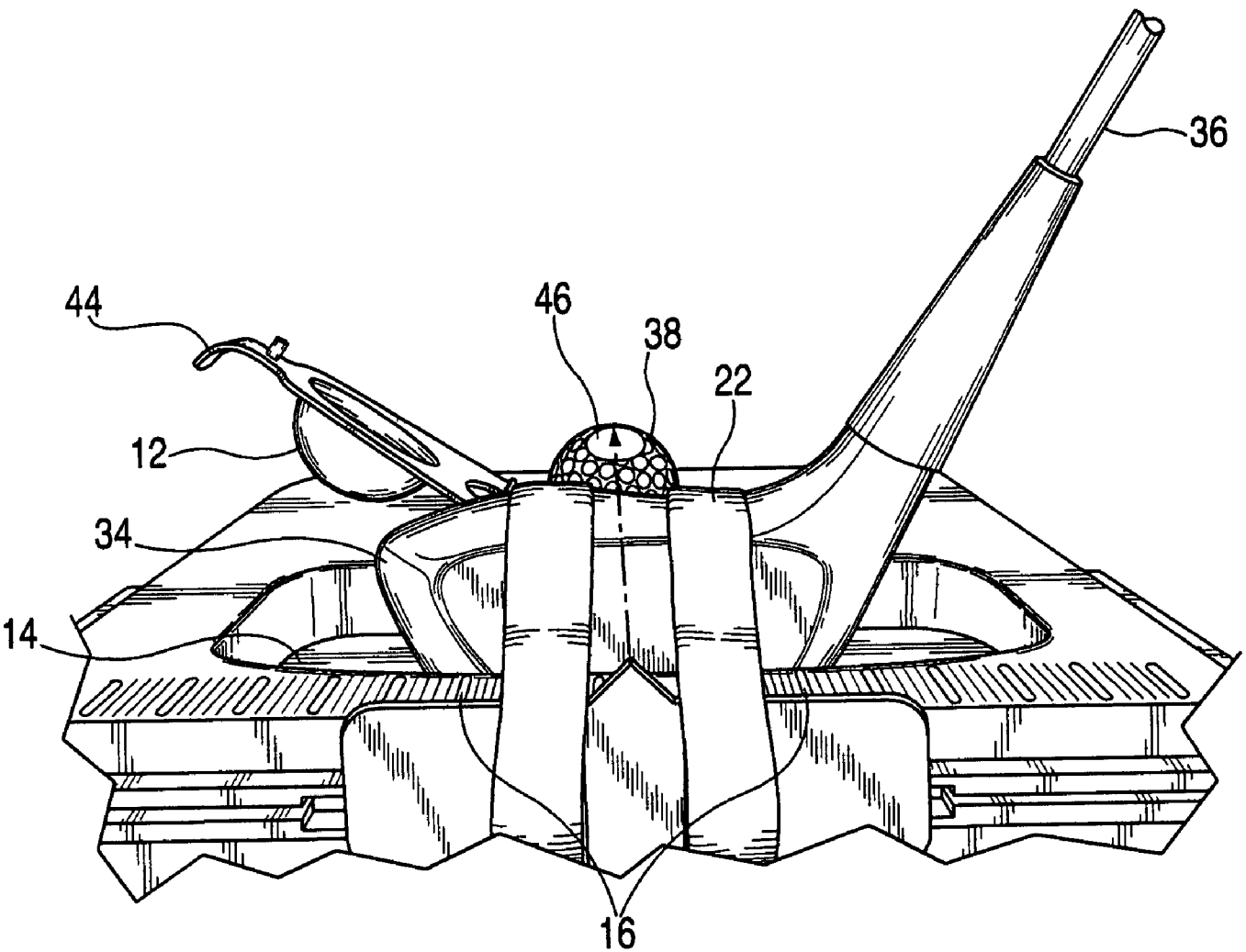
FIG. 6 is a close-up front view of the golf club and ball marking/alignment device showing the club face and golf ball in proper alignment positions.

FIG. 6 is a close-up view of the relationship and alignment of golf club head 34, golf club face centering marks 16, golf club head centering band 22 as it is draped and positioned over golf club head 34. Golf club head centering band 22 provides a central channel for marking golf club head 34. With golf club head centering band 22 in place, the center of the face of golf club head 34 is can be determined using golf club face centering marks 16. FIG. 6 illustrates that golf club head centering band 22 also secures golf club head 34 within golf club well 14. In this position, alignment of golf club head 34, golf ball 38 and golf ball alignment/marking area 46 are easily visualized.

Figure 7:
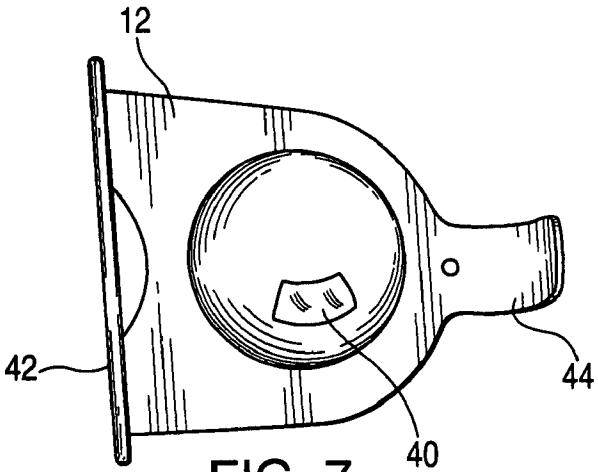
FIG. 7 is a close view of the golf ball cover.
Figure 9:
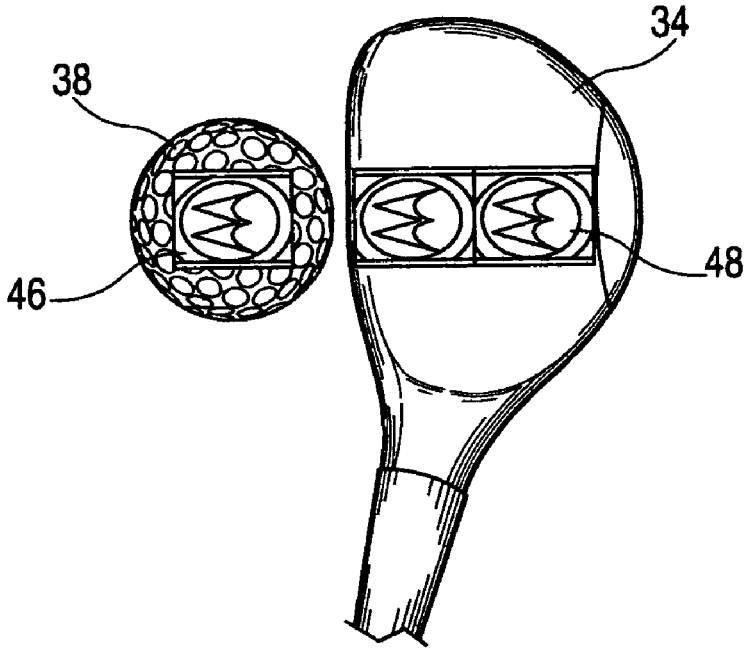
FIG. 9 is an example of a marked golf club and ball aligned using a registered Trademark.

FIG. 7 is a close-up view of golf ball cover 12 noting golf ball cover handle 44, golf ball cover marking window 40 in the center of golf ball cover 12. Golf ball cover hinge 42 provides a means of attachment of golf ball cover 12 to golf club and ball marking/alignment device body 10.

Figure 8:
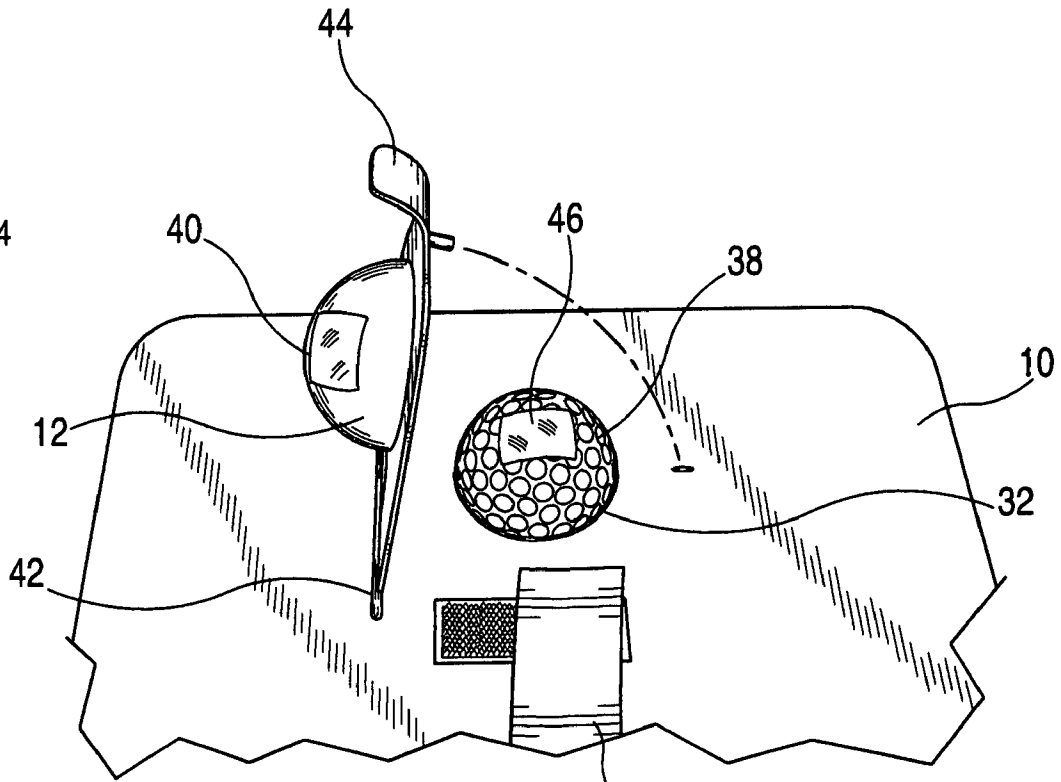
FIG. 8 is a view of the golf ball cover lifted with a golf ball in proper position for marking and alignment.

FIG. 8 shows the positional relationship of golf ball cover 12 now in the open position, and it's attachment to body 10 along with golf ball 38 placed within golf ball well 32.

FIGS. 9, 10, 11, 12, & 13; are examples of different types of marking that can be made using this novel device which provide identification, security, and alignment of golf club head 34 and golf ball 34. All of the examples have been marked using the novel golf club and ball marking/alignment device 10 and its related components. The resultants provided by this golf club and ball marking/alignment device yields a variety of easy to see indicia within the provided golf ball marking/alignment area 46 and golf club marking/alignment area 48.

Operation—FIGS. 1, 2, 3, 4, 5, 6, 7, 8

Marking and Aligning a Golf Club

FIGS. 1–5: An operator of golf club and ball marking/alignment device 10 begins by lifting golf club head centering band 22 upward and back toward the front face of body 10 thereby exposing golf club head well 14. Golf club head well 14, is constructed as having an arc on the front face of golf club head well 14. This curvature forms an arc which is best viewed in FIG. 3. Once a golf club head 34 (FIGS. 4 & 5) is placed within golf club head well 14, golf club head centering band 22 is then moved and positioned back over golf club head 34 and anchored to body 10 through securing strap 24 (FIGS. 3 & 5). Centering guide securing band 24 is fed through openings 30 in body 10 which serves to keep golf club head centering band 22 aligned straight and secured to body 10. In FIG. 3, golf club head centering band 22 and centering guide securing band 24 is depicted traversing the exact center of golf club well 14 in the fastened position.

FIG. 2, is a cross sectional view dividing body 10 at its midline and is taken at lines 2—2 in FIG. 1. Golf club well 14 is constructed wide enough to accommodate all clubs including drivers, irons, and putters. Golf club well 14 depth is such that when a club head 34 is placed with golf club well 14 (FIG. 4) the face or striking surface of a golf club head is exposed allowing for measurement. Golf ball well 32 (FIG. 2) is of sufficient size and depth to allow for approximately one half of a standard golf ball to be placed within.

FIGS. 4 & 5. With a golf club head 34 placed within golf club head well 14, golf club head centering band 22 courses over the top of golf club head 34. Golf club head centering band 22 terminates by having centering guide securing band 24 course through openings 30 in body 10. Securing band 24 is then fixed to body 10 using an attachment means such a Velcro® strap. The center of golf club head 34 can now be found by using golf club face centering marks 16. These centering marks 16 are found on the top surface of body 10 just in front of golf club head well 14. The curvature of golf club well 14 which forms an arc, assists the operator to align the face of golf club head 34 as golf club head band 22 is tightened. Although golf club head 34 appears as centered, some minor adjustment may be necessary. Golf club face centering marks 16 are used to make fine adjustments. The operator needs only to slightly slide golf club head 34 left or right while looking the face of golf club head 34 (FIG. 6). The operator should count an equal number of golf club face centering marks 16 on each side of the center point within golf club head band 22. This finds the exact center of the face golf club head 34. FIG. 4, golf club shaft 36 rests on the upper end of golf club shaft support arm 18 which has a golf club shaft centering guide 20 at its top end. The height of golf club shaft support arm 18 is adjustable for the different type of clubs by loosening golf club support arm adjusting screw 50 and sliding support arm 18 up or down. Raising or lowering golf club shaft 36 allows for insuring the bottom surface of golf club head 34 is level within golf club well 14. Continuing with FIG. 4, golf club shaft support arm 18, also slides front to back of body 10 along golf club support guide 26 for right handed clubs. To provide support for left handed clubs, one will place golf club shaft support arm 18 on golf club support guide 28 and adjust accordingly.

Having found the center of the face (FIG. 6) of golf club head 34, an operator may now place a label, marking or other such indicia on golf club head 34 within the two bands of golf club head centering band 22. Some examples of golf club markings 48 placed within the two bands of golf club head centering band 22 can be seen in FIGS. 9, 10, 11, 12 & 13.

Marking and Aligning a Golf Ball

To place identification marks and provide alignment marks on a golf ball, one begins by directing attention to FIGS. 4–8. Golf ball cover 12 viewed in FIG. 4 in the closed position. In order to gain access to golf ball well 32, golf ball cover handle 44 is lifted and moves golf ball cover 12 its open position. FIGS. 7 & 8 are close-up views of golf ball cover 12 along with its related components golf ball cover handle 44 and golf ball cover hinge 42. Golf ball cover handle 44 provides a means to lift and open golf ball cover 12 while hinge 42 is a means of attachment for golf ball cover 12 to body 10. Golf ball marking window 40, is an opening in golf ball cover 12 that allows access to the surface of a golf ball 38 when placed below the golf ball cover 12 in the closed position.

In FIG. 8, a golf ball 38 is placed in golf ball well 32 while golf ball cover 12 is open. Golf ball cover 12 is then closed only exposing the surface of golf ball 38 which is below the golf ball marking window 40 (FIG. 4). This exposed surface of golf ball 38 below golf ball marking window 40 can now be marked in many ways including ink, labels, marks, words, stickers, symbols, or other such indicia. Golf ball marking window 40 is equally as wide as the central part of golf club head centering band 22.

Combining a Marked Golf Club and Golf Ball For Alignment. FIGS. 9, 10, 11, 12

Figure 10:
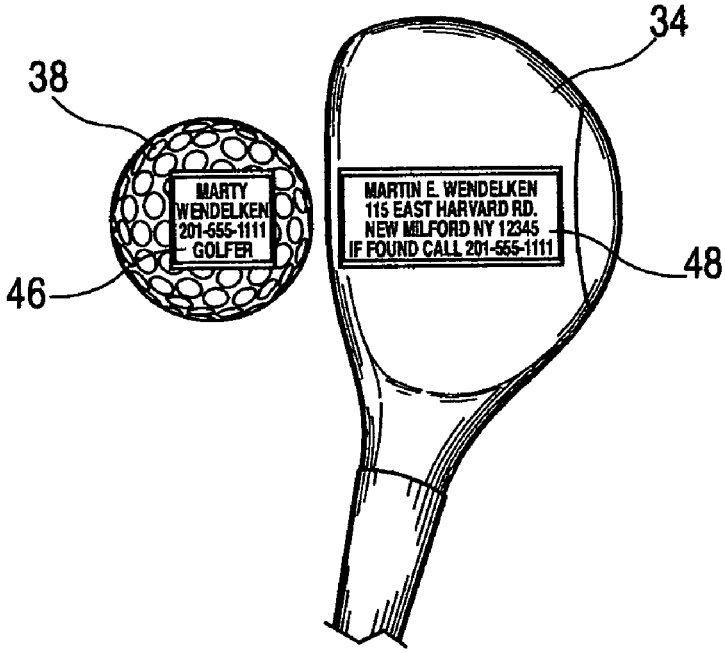
FIG. 10 is an example of a marked golf club and ball aligned using lines of text such as a name and street address.

After marking golf club head 34 and golf ball 38, a golfer may now utilize these markings for a number of purposes. A first example is the use of a Trademark such as the one in FIG. 9, (a registered Trademark of Motorola Inc. USA). Here this Trademark serves to provide identification of both golf club 34 and golf ball 38. Further this Trademark also provides alignment for the person who is playing golf. Golf ball marking/alignment area 46 and golf club marking/alignment area 48, give the center of the club face and the center of the golf ball using this golf ball and golf club marking and alignment device 10. Such marks may be placed on any clubs both new and old. Other marks such as the example shown in FIG. 10 further illustrate the ability to mark golf balls and clubs for security purposes. FIG. 10 has golf club head 34 with the owners name and address in small print affixed. When playing golf and standing in a position to hit a golf ball, golf club marking/alignment area 48 appears to have straight lines. This appearance of straight lines is due to the distance between the eyes of the golfer and the club on the ground. Golf ball 38 in FIG. 10 has lines of print with small letters. Such writing serves to identify the owner, gives added security of golf ball 38 and other marked equipment. Theses same marking also provides alignment between golf club 34 and golf ball 38 while playing golf.

Figure 11:
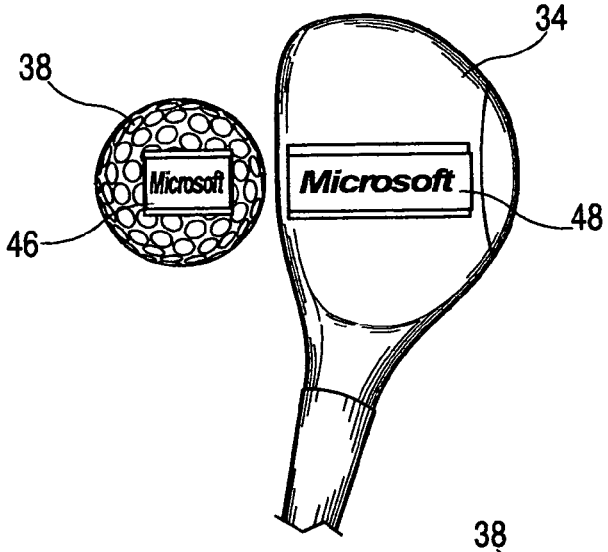
FIG. 11 is an example of a marked golf club and ball aligned using a registered Word-Mark.
Figure 12:
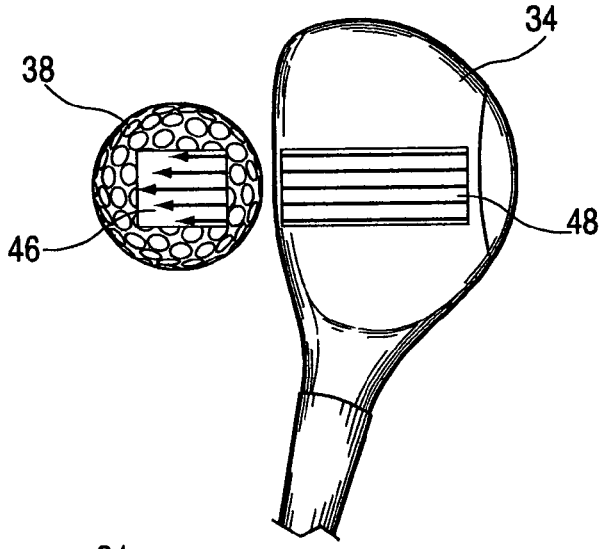
FIG. 12 is an example of a marked golf club and ball aligned using lines.
Figure 13:
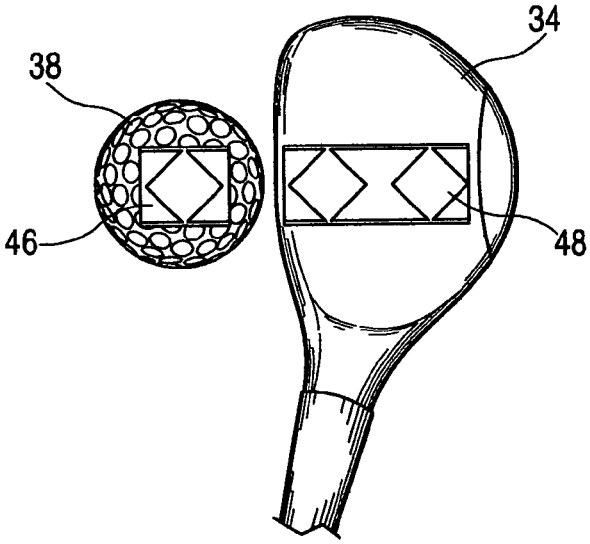
FIG. 13 is an example of a marked golf club and ball aligned using a symbol or shape.

FIG. 11 has an example of a company name or a registered Service-Mark (MicroSoft is a registered Trademark and Service-Mark of the MicroSoft Corporation, USA), which provides identification and security marks for a golfer and acts as an alignment tool for golf club head 34 and golf ball 38. FIG. 12 is an example of some straight lines on a label which are place within golf club head centering band 22 which provides a golf club marking/alignment area 48 on golf club head 34. These same lines are place on golf ball 38. The combination of both marks on golf club head 34 and golf ball 38 provides the owner of the golf equipment with both identification of equipment, (security) and alignment during play. FIG. 13 is still another example of marking that provide identification of equipment (security) and ball and club alignment during play. This example uses a geometric symbol place in golf ball marking/alignment area 46 on golf ball 38 and golf club marking/alignment area 48 on golf club head 34.

SUMMARY AND SCOPE

After reading the fore stated description of the novel golf ball and golf club marking/alignment device 10 it becomes apparent that this invention provides a novel method of finding the center of the face of a golf club head 34 and a system for marking this same golf club head 34. This same device provides for also marking a golf ball 38 on its surface. The combination of marking a golf club head 34 and a golf ball 38 provides its user with a number of additional benefits including:

- The ability to provide a simple method of identifying a person's golf equipment.
- The unlimited type markings to be placed on both a golf club head 34 and golf ball 38 including pictures, Trademarks, Service Marks, symbols, words, lines and more.
- A novel device that can be use on both new and used equipment
- Markings may be place on all type and sizes of golf clubs including drivers, putters, irons and wedges.
- The device can be used to mark and center on both right handed and left handed golf club heads.
- Custom markings on a golf ball 38 and a golf club head 34 act as a security device in that such marking will discourage theft including a persons name and address.

Finally, the describe golf club and ball marking/alignment device provides a method of placing marks on a golf club head 34 and golf ball 38 that serves as an alignment tool for its user while playing golf. The rules of the game of golf allows for the marking of golf club heads 34 and golf balls 38. These same rules allow for ball placement in a number of situations during play such as while putting on a green and placing a ball on a golf tee. This ability to pickup and position a golf ball 38 allows for the alignment of both a golf club head 34 and a golf ball 38 with a golf tee. Such alignment will allow for more accurate drives and putts.

The above description shall not be construed as limiting in ways which this invention may be practiced but shall be inclusive of many other variations by those skilled in the art whose changes or modification could be made without departing from the broad interest, intent, and true spirit of this invention.

Having described our invention what is claimed is:

1. A method of marking and aligning golf club heads and golf balls, comprising the steps of:

providing a body containing a first well to accommodate golf club heads of various heights and widths, said well containing a wall having an arch to accommodate the golf club head when placing within said well;

providing a golf club head centering band attached to said body, said centering band having a central portion removed which provides an opening and access to the top surface of said golf club head;

securing said golf club head within said well by placing said golf club head centering band over the dorsal surface of said golf club head;

providing an adjustable arm to said body to provide support for a golf club shaft;

providing a second well in said body to accommodate a golf ball and in axial alignment with said first well;

proving a golf ball cover to enclose said golf ball, and said golf ball cover having a window of equal width as said opening of said centering band;

providing indicia to said golf ball and said golf club head as a means of identification and alignment of said golf ball and said golf club head during play, said indicia being one of: shapes, lines, marks, labels, pictures, and symbols.

* * * * *